US009457327B2

(12) United States Patent
Jacobs

(10) Patent No.: US 9,457,327 B2
(45) Date of Patent: Oct. 4, 2016

(54) METHOD AND APPARATUS FOR TREATMENT AND PURIFICATION OF LIQUID THROUGH AERATION

(71) Applicant: John L. Jacobs, Earlham, IA (US)

(72) Inventor: John L. Jacobs, Earlham, IA (US)

( * ) Notice: Subject to any disclaimer, the term of this patent is extended or adjusted under 35 U.S.C. 154(b) by 9 days.

(21) Appl. No.: 14/156,022

(22) Filed: Jan. 15, 2014

(65) Prior Publication Data

US 2014/0197555 A1 Jul. 17, 2014

Related U.S. Application Data

(60) Provisional application No. 61/752,519, filed on Jan. 15, 2013.

(51) Int. Cl.

| | |
|---|---|
| ***B01F 7/00*** | (2006.01) |
| ***B01F 7/26*** | (2006.01) |
| ***B01F 15/00*** | (2006.01) |
| ***B01F 3/04*** | (2006.01) |

(52) U.S. Cl.

CPC ..... *B01F 7/00458* (2013.01); *B01F 3/04609* (2013.01); *B01F 7/00491* (2013.01); *B01F 7/00733* (2013.01); *B01F 7/26* (2013.01); *B01F 15/00889* (2013.01); *B01F 2003/04858* (2013.01); *B01F 2215/0427* (2013.01); *B01F 2215/0431* (2013.01)

(58) Field of Classification Search

CPC .. B01F 7/00458; B01F 7/26; B01F 7/00491; B01F 15/00889; B01F 2003/04858; B01F 2215/0427; B01F 2215/0431; B01F 3/04609; B01F 3/04531

See application file for complete search history.

(56) References Cited

U.S. PATENT DOCUMENTS

| | | | | | |
|---|---|---|---|---|---|
| 2,692,127 | A * | 10/1954 | Conn | B01F 7/00475 | 416/181 |
| 3,497,185 | A * | 2/1970 | Dively | 261/36.1 | |
| 3,591,149 | A * | 7/1971 | Auler | 261/91 | |
| 3,606,577 | A * | 9/1971 | Conn | B02C 17/163 | 416/181 |
| 3,646,927 | A * | 3/1972 | Perl | F24C 3/12 | 126/39 J |
| 3,823,923 | A * | 7/1974 | Chapsal | B01F 3/04617 | 261/93 |
| 4,813,787 | A * | 3/1989 | Conn | B01F 7/00475 | 366/293 |
| 5,194,144 | A * | 3/1993 | Blough | B01F 3/04439 | 210/219 |
| 5,951,867 | A * | 9/1999 | Blough | B01F 3/04439 | 210/532.2 |

(Continued)

*Primary Examiner* — Amber R Orlando
*Assistant Examiner* — Stephen Hobson
(74) *Attorney, Agent, or Firm* — Zarley Law Firm, P.L.C.

(57) ABSTRACT

An aeration system for the treatment and purification of liquid is presented. The aeration system includes a decompression chamber extending a length between an inlet end and an outlet end and a motor connected to the decompression chamber. The system includes drive shaft connected to the motor and extending into a hollow interior of the decompression chamber wherein airflow into the hollow interior is restricted through at least one inlet port. An orifice plate is connected to the drive shaft, wherein the orifice plate includes a plurality of apertures. A rotor disk is connected to the drive shaft, wherein the rotor disk includes a plurality of deflecting blades. When the outlet end of the system is positioned in liquid and the driveshaft and rotor disk are rotated micro bubbles are formed in the liquid thereby treating and purifying the liquid.

12 Claims, 4 Drawing Sheets

(56) References Cited

U.S. PATENT DOCUMENTS 6,245,237 B1 6/2001 Blough et al.
6,461,500 B1 * 10/2002 Hoage ..... B01F 3/04262 210/150
6,575,616 B2 * 6/2003 D'Agostino ..... B01F 7/00208 366/316
6,818,136 B1 * 11/2004 Marek ..... B09C 1/002 210/170.07
6,884,353 B2 4/2005 Hoage et al.
6,997,444 B2 * 2/2006 Weetman ..... B01F 3/0478 210/219
7,306,722 B1 * 12/2007 Hoage ..... B01F 3/04609 210/220
7,425,269 B2 9/2008 Hoage
7,513,678 B2 * 4/2009 Venus ..... B01F 7/001 366/129
7,651,075 B2 1/2010 Rho et al.
2003/0042200 A1 * 3/2003 Hoage ..... B01F 3/04262 210/620
2006/0233044 A1 * 10/2006 Freeman ..... B01F 7/26 366/316
2008/0156727 A1 * 7/2008 Hoage ..... B01F 3/04609 210/629
2008/0296788 A1 * 12/2008 Rho ..... B01F 3/04609 261/93
2015/0078976 A1 * 3/2015 Bui ..... F01N 3/2066 423/212
2015/0273411 A1 * 10/2015 Chapman ..... F01N 3/2066 60/301
2015/0352504 A1 * 12/2015 Latva-Kokko ..... B01F 7/00641 261/84
2015/0352507 A1 * 12/2015 Jeronimo ..... B01F 1/0011 241/41
2016/0023982 A1 * 1/2016 Dienes ..... C07C 51/43 562/593
2016/0030902 A1 * 2/2016 Firestone ..... F04D 29/2288 416/228

* cited by examiner

METHOD AND APPARATUS FOR TREATMENT AND PURIFICATION OF LIQUID THROUGH AERATION

CROSS REFERENCE TO RELATED APPLICATION

This application claims the benefit of U.S. Provisional Application No. 61/752,519 filed Jan. 15, 2013;

BACKGROUND OF THE INVENTION

The invention relates to a method and apparatus for aeration and more particularly to a method and device that more efficiently treats and purifies liquid through aeration.

Aeration devices are well-known in the art and are used for a variety of purposes such as for decomposing waste. While these devices have achieved desired results, based on current designs, the devices place a substantial amount of stress on the motors often burning out the motor requiring replacement. Also, because of the limitations of the motors, the amount of air flow generated for aeration is also limited which affects the ability to produce micro bubbles. As such, a need exists in the art for a method and device that addresses these deficiencies.

Thus, an objective of the invention is to provide a method and apparatus for treatment and purification of liquid through aeration that improves upon the state of the art.

Another object of the invention is to provide a method and apparatus for treatment and purification of liquid through aeration that places less stress on a motor and increases air flow.

Yet another object of the invention is to provide a method and apparatus for treatment and purification of liquid through aeration that is robust.

Another object of the invention is to provide a method and apparatus for treatment and purification of liquid through aeration that is easy to use.

Yet another object of the invention is to provide a method and apparatus for treatment and purification of liquid through aeration that produces micro bubbles that remain suspended within the liquid for an extended period of time and therefore have a greater tendency to dissolve gasses within the liquid.

Another object of the invention is to provide a method and apparatus for treatment and purification of liquid through aeration that is simple.

Yet another object of the invention is to provide a method and apparatus for treatment and purification of liquid through aeration that reduces the odor of waste liquid and effluent.

Another object of the invention is to provide a method and apparatus for treatment and purification of liquid through aeration that promotes bacteria growth and the aerobic breakdown of waste liquid and effluent.

These and other objects, features and advantages will be apparent to those skilled in the art based upon the following written description, drawings and claims.

SUMMARY OF THE INVENTION

An aeration system for the treatment and purification of liquid is presented. The aeration system includes a decompression chamber extending a length between an inlet end and an outlet end and a motor connected to the decompression chamber. The system includes drive shaft connected to the motor and extending into a hollow interior of the decompression chamber wherein airflow into the hollow interior is restricted through at least one inlet port. An orifice plate is connected to the drive shaft, wherein the orifice plate includes a plurality of apertures. A rotor disk is connected to the drive shaft, wherein the rotor disk includes a plurality of deflecting blades. When the outlet end of the system is positioned in liquid and the driveshaft and rotor disk are rotated micro bubbles are formed in the liquid thereby treating and purifying the liquid.

DETAILED DESCRIPTION OF THE PREFERRED EMBODIMENTS

Conventional Aeration

Figure 1:
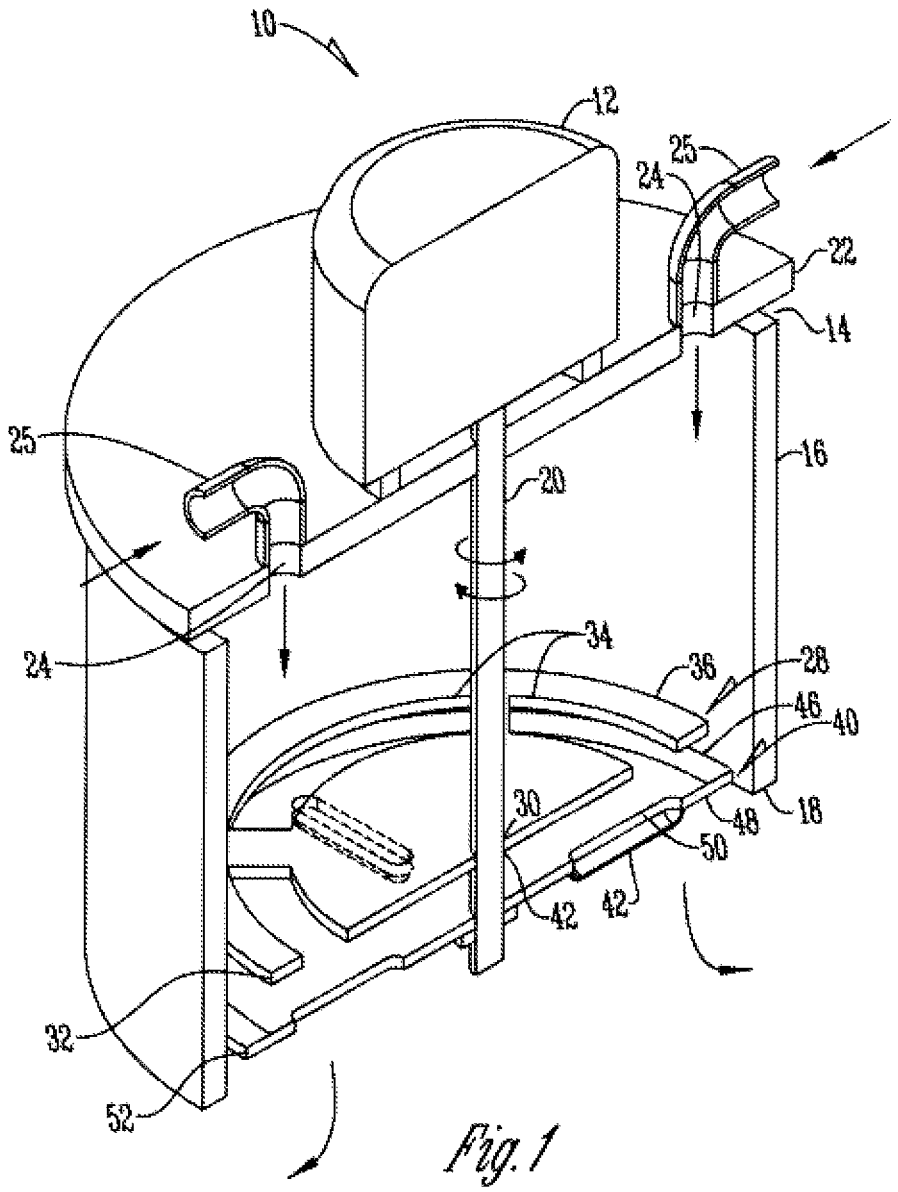
FIG. 1 is a cut-away perspective view of a micro bubble diffusion system.

Most aeration equipment in use today utilizes compressed air systems. They introduce bubbles of air into liquid by forcing compressed air through a fine pore diffuser. Experimental results with these systems have shown that the minimum bubble sizes generated are greater than 3 to 4 millimeters in diameter. Bubbles of this size quickly rise to the surface and are lost. They do not remain in the water long enough to transfer an appreciable amount of oxygen to the liquid.

The Effect of Bubble Size in Aerobic Aeration:

As the total surface area of a population of bubbles increases, oxygen transfer efficiency (OTE) increases. For the same volume of air, many small bubbles have a greater surface area than fewer large bubbles.

Typical compressed air diffusers, which are found in many municipal and industrial waste treatment processes, frequently produce bubbles 20 mm or greater in diameter. These bubbles have a small combined surface area for a given volume, and they also rise to the surface quickly. While advances in fine-pore diffusers have led to the development of aeration systems producing bubbles averaging 3 to 4 mm in diameter, this is still insufficient. This represents the state of the art in compressed air systems.

Fine Bubble Diffusion and Aerobic Bacteria

It is expected that in the conventional septic tank or waste lagoon the organic waste contained therein is digested. However, when there is a deficiency of oxygen, or other necessary dissolved gasses, this is not the case. Instead, the organic waste builds up over time and the tanks and lagoons are nothing more than containers for sedimentation and sludge storage. As such, the bacteria in conventional septic digestion are anaerobic and are accompanied by odorous gases and groundwater contaminating pathogens. In addition, when sedimentation builds up over time, this buildup must be dealt with and require costly sediment removal.

Aerobic Efficiency:

By supplying enough oxygen, an aerobic condition is developed. Bacteria that obtain their energy aerobically are much more efficient at breaking down waste water and effluent. The same organic waste food supply supports a much larger bacterial flora by aerobiosis than anaerobiosis, and therefore, aerobic decomposition of organic matter is much more rapid. Aerobiosis in activated sludge is substantially complete in six to eight hours, whereas conventional septic digestion of sewage sludge requires about 60 days.

Nitrification:

The usual end products from anaerobic decomposition are carbon dioxide, methane, ammonia, and hydrogen sulfide. Whereas, the end products of aerobic bacteria are carbon dioxide, ammonia, water, and sulfates. The ammonia is not given off as a gas, and instead is nitrified by the aerobs Nitrosomonas—oxidizing the ammonia into nitrite, and Nitrobacter—oxidizing the nitrite into non-toxic nitrate. Nitrates are directly plant usable and will not harm fish. The only gas given off by aerobic bacteria is odorless carbon dioxide, thereby eliminating any offensive odor.

Micro Bubble Diffusion System:

Referring to the Figures, the micro bubble diffusion system 10 is presented that has a motor 12 mounted to the top or inlet end 14 of a decompression chamber 16. The decompression chamber 16 extends a length between the inlet end 14 and an opposite outlet end 18.

Motor 12 is formed of any type of a motor-type device which converts one form of energy into rotation such as an electric motor, hydraulic motor, pneumatic motor, turbine motor, steam motor, or the like. However, electric motors are most commonly used.

Decompression chamber 16 is formed of any suitable size, shape and design. In one arrangement, as is shown, decompression chamber 16 is formed of a generally cylindrical member which extends from inlet end 14 to outlet end 18 with approximately straight and parallel opposing walls. Alternatively, to increase the venturi affect, the decompression chamber 16 narrows near the outlet end 18, or along its length from the inlet end 14 to the outlet end 18. Decompression chamber 16 is formed of any suitable material. However a length of PVC pipe has been used with success due to its structural rigidity and resistance to the elements, however any other plastic or composite material is hereby contemplated for use, as is any other rigid and durable material.

A drive shaft 20 is rotatably connected to the motor 12 and extends a length through approximately the center of decompression chamber 16. Motor 12 is mounted to a mounting plate 22 which is connected to the inlet end 14 of decompression chamber 16, or alternatively it is positioned within the decompression chamber 16 a distance from the inlet end 14. Drive shaft 20 extends through an opening in mounting plate 22.

Mounting plate 22 includes at least one, if not a plurality of, inlet ports 24 therein. Mounting plate 22 serves to connect and hold motor 12 to decompression chamber 16 as well as to restrict airflow into the hollow interior of the decompression chamber 16. Inlet ports 24 allow a controlled amount of airflow into the hollow interior of decompression chamber 16. The number and size of these inlet ports 24, and the amount of gas that they allow to travel there through can be balanced to the other components of the system 10 to provide optimal performance, as is further described herein. Inlet ports 24 may simply be an opening in mounting plate 22, which are static in size, or alternatively inlet ports 24 may include a tube or valve-type member 25 which can be adjusted, manually or automatically (such as through a solenoid or the like), to adjust the amount of gas the inlet ports 24 allow to pass into decompression chamber 16.

In an alternative arrangement, the inlet ports 24 are connected to a source of gas 26 (not shown) for various treatments, such as the use of $CO_2$ for use in the growth of algae and the like.

Positioned within the decompression chamber 16 is a venturi or orifice plate 28. The orifice plate 28 includes a central opening 30 through which drive shaft 20 extends. In one arrangement, orifice plate 28 is connected to drive shaft 20 at central opening 30, such that in this arrangement when drive shaft 20 rotates, so rotates orifice plate 28. In this arrangement, the exterior diameter 32 of orifice plate 28 fits within close tolerances to the interior diameter of decompression chamber 16 so as to minimize the amount of gas that can travel between the interior diameter of decompression chamber 16 and exterior diameter 32 of orifice plate 28. In an alternative arrangement, orifice plate 28 is not connected to drive shaft 20 at central opening 30, such that in this arrangement when drive shaft 20 rotates, orifice plate 28 remains stationary. In this arrangement, orifice plate 28 is connected to and held by decompression chamber 16.

Orifice plate 28 has a plurality of apertures 34 that are positioned between the central opening 30 and the exterior diameter 32 of the orifice plate 28. The apertures 34 are of any size, shape and structure and can include circular apertures 34C, slot apertures 34S, and curved apertures 34V, among countless other sizes, shapes or designs. In one arrangement, apertures 34 extend radially outward in relation to the center opening 30. In one embodiment the size of the aperture 34 is larger on the top surface 36 of the orifice plate 28 than the bottom surface 38 of the orifice plate 34 to enhance the venturi effect. Examples of various configurations are shown in the Figures. As is shown, in one arrangement, drive shaft 20 extends through and a distance beyond orifice plate 28.

Positioned below orifice plate 28, and mounted to the drive shaft 20, is a rotor disk 40. Rotor disk 40 is formed of any suitable size, shape and design. In one embodiment, as is shown, rotor disk 40 has a plurality of deflecting blades, or louvers 42 that are angled from the top surface 46 of rotor disk 40 to the bottom surface 48 of rotor disk 40. In the arrangement wherein the deflecting blades 42 are louvers, an opening 50 is positioned just rearward, in the direction of rotation of rotor disk 40, from deflecting blade 42. This opening 50 is formed by bending the deflecting blade 42 portion of rotor disk 40 out of alignment with the main body of the generally flat and planar rotor disk 40. Any angle of deflection is hereby contemplated for use between 0 degrees and 90 degrees, however an angle of alignment between 10 degrees and 70 degrees has been used with success, and more specifically between 20 and 60 degrees. The angle of deflecting blades 42 can be varied depending on the size of the system 10, the fluid dynamics, the strength of the motor 12 or any other variable. In an alternative arrangement, the deflecting blades 42 extend upwardly from rotor disk 40. Rotor disk 40 may also include apertures, like the apertures 34 in orifice plate 28 (such as circular apertures 34, slot apertures 34S, curved apertures 34V or the like) along with deflecting blades 42 and openings 50 associated with those deflecting blades 42. In yet another alternative arrangement, an opening 50 is not necessarily associated with a deflecting blade 42. That is, in this arrangement, the deflecting blade 42 is attached to the surface of rotor disk 40, and is not formed out of the rotor disk material like a louver would be, and therefore there is no associated opening 50 directly behind the deflecting blade 42. These added or attached deflecting blades 42 can be welded or attached to rotor disk 40 in any manner and in any position including over or adjacent to apertures 34 in rotor disk 40.

In one arrangement, the openings 50 in rotor disk 40 rear of deflecting blades 42 are approximately slot shaped, or approximately rectangular in shape. In one arrangement, there are a corresponding number of apertures 34 in orifice plate 28 as there are openings 50 in rotor disk 40. In one arrangement, these openings 50 of the rotor disc 40 are larger than the apertures 34 of orifice plate 28.

In one arrangement, the apertures 34 of orifice plate 28 are in vertical spaced alignment above the openings 50 of rotor disk 40. When both the orifice plate 28 and rotor disk 40 are connected to drive shaft 20, the apertures 34 of orifice plate 28 remain in vertical spaced alignment as they are rotated by drive shaft 20.

Typically, the exterior diameter 52 of the rotor disc 40 is smooth and fits within the inner diameter of decompression chamber 16 within close tolerance. This prevents liquid from passing between the exterior diameter 52 of the rotor disk 40 and the decompression chamber 16. However, in alternative embodiments the exterior diameter 52 is jagged or non-uniform, such as saw tooth shaped or the like. Also, in one arrangement the exterior most edge of apertures 34, and/or openings 50 terminate at least ½ an inch, and more specifically ⅝ of an inch, from the exterior diameter 32, 52 of the respective orifice plate 28 or rotor disk 40.

In an alternative arrangement, the exterior diameter 32, 52 of orifice plate 28 and rotor disk 40 have a smaller diameter than the inner diameter of decompression chamber 16. This provides a space between these components, which allows fluid to flow up into the decompression chamber 16 during operation. The optimal distance between the exterior diameter 32, 52 of orifice plate 28 and rotor disk 40 and the inner diameter of decompression chamber 16 is dependent on many variables such as the size of the system, the pressure within the decompression chamber 16, the power of the motor 12, the fluid dynamics of the liquid, the size and shape of the apertures 34 and openings 50 and the deflecting blades 42, among countless other variables.

In one arrangement orifice plate 28 and the rotor disk 40 rotate with one another. In this arrangement, orifice plate 28 and rotor disk 40 are positioned near, adjacent and/or in abutting engagement with one another. In an alternative arrangement, orifice plate 28 and rotor disk 40 are positioned such that space is created between the two. Testing of some arrangements has revealed that a space of greater than ½ inch between orifice plate 28 and rotor disk 40 is too much, whereas spacing of approximately 3⁄16 of an inch between orifice plate 28 and rotor disk 40 has been tested with success. The exact spacing between orifice plate 28 and rotor disk 40 of between 0 inches ½ inches, or more, is dependent on many variables such as the size of the system, the pressure within the decompression chamber 16, the power of the motor 12, the fluid dynamics of the liquid, the size and shape of the apertures 34 and openings 50 and the deflecting blades 42, among countless other variables.

The rotor disk 40 is positioned anywhere within the open interior of the decompression chamber 16, from in alignment with the outlet end 18 of the decompression chamber 16 to near the inlet end 14 of the decompression chamber 16. However, the system 10 has been tested with success when the bottom of the rotor disk 40 is positioned at least 3 inches or more from the outlet end 18 of the decompression chamber 16.

In one arrangement, the system has been tested with success when the rotor disk 40 is submerged into the liquid to be treated. The amount of submersion is dependent on many variables such as the size of the system, the pressure within the decompression chamber 16, the power of the motor 12, the fluid dynamics of the liquid, the size and shape of the apertures 34 and openings 50 and the deflecting blades 42, among countless other variables. However submersion of between 1 inch and 24 inches has been tested with success, and more specifically at least 6 inches or more has been tested with success. This submersion creates a partial vacuum into the liquid.

In one arrangement, a flotation device 54 (not shown) is connected to system 10. Flotation device 54 is formed of any suitable size, shape and design and serves to provide buoyance to system 10 so that system 10 floats on the surface of the liquid that it purifies. Alternatively, system 10 is affixed to a structure like a wall or dock or the like.

Figure 3:
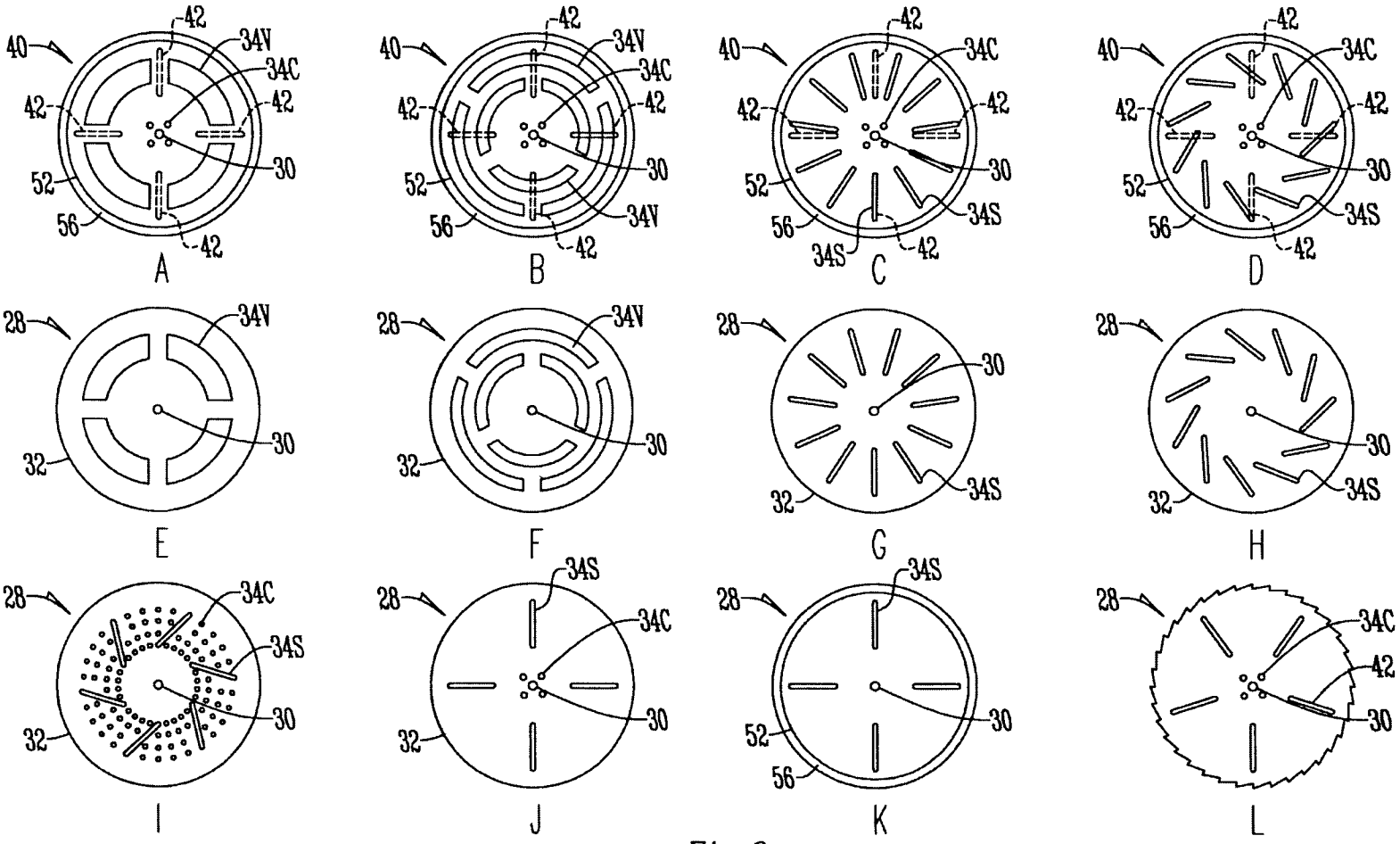
FIG. 3 is a plan view of orifice plate embodiments.
Figure 4:
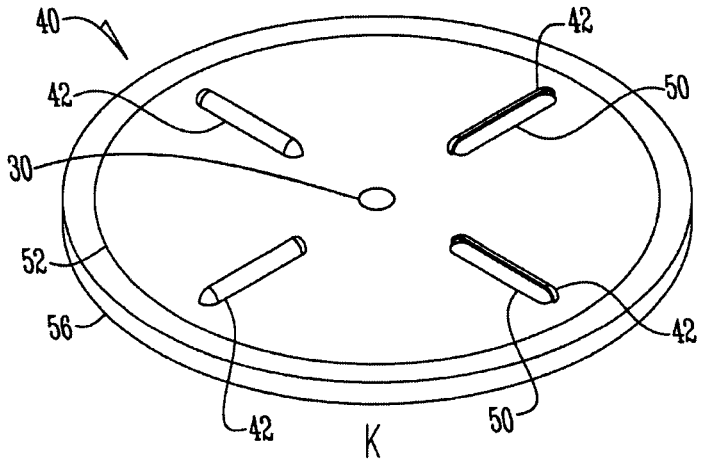
FIG. 4 is a perspective view of rotor disk embodiments
Figure 4:
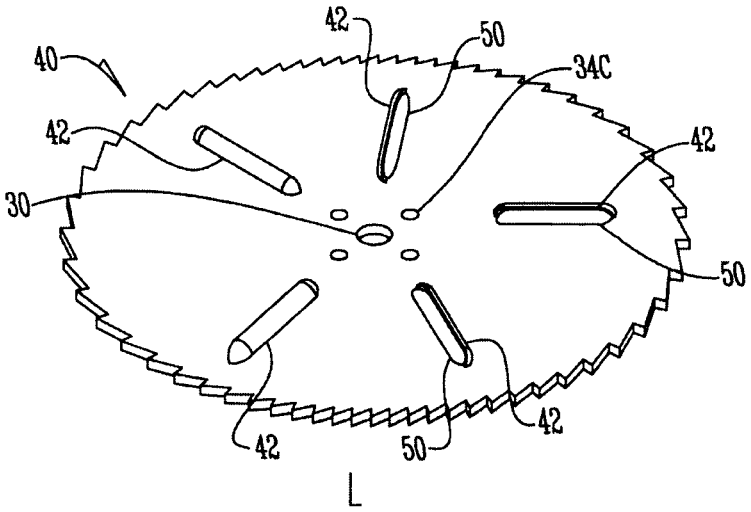

With reference to FIG. 3, the top row shows a plurality of different arrangements of rotor disks 40 (elements A, B, C and D) and the middle rows shows a plurality of different arranges of orifice plates 28 (E, F, G, H) and the bottom row shows two more arrangements of orifice plates 28 (I, J) and two more arrangements of rotor disks 40 (K, L). More specifically:

Embodiment A - shows a rotor disk 40 that includes four circular apertures 34C adjacent central opening 30, four wide curved apertures 34V and four deflecting blades 42 (extending out of the bottom side of rotor disk 40) which are formed as louvers which are positioned between the ends of the curved apertures 34 and extend straight outward alignment with the axis of rotation. This arrangement also shows an optional ring or sealing ring 56 positioned around the exterior diameter 52 of the rotor disk 40.

Embodiment B - shows a rotor disk 40 that includes three exterior curved apertures 34V positioned in staggered alignment to three interior curved apertures 34V which are positioned around opening 30. Rotor disk 40 includes four deflecting blades 42 (extending out of the bottom side of rotor disk 40) which are connected to rotor disk 40 in straight outward alignment with the axis of rotation. These deflecting blades 42 cross a portion of at least one curved aperture 24V. This arrangement also shows an optional ring or sealing ring 56 positioned around the exterior diameter 52 of the rotor disk 40.

Embodiment C - shows a rotor disk 40 that includes four circular apertures 34C adjacent central opening 30 and eleven slot apertures 34S positioned in straight outward alignment with the axis of rotation. The rotor disk 40 also includes four deflecting blades 42 (extending out of the bottom side of rotor disk 40), which are connected to the rotor disk 40. One of these deflecting blades are positioned in alignment with a slot aperture, whereas the others are positioned a space away from a slot opening 34S. This arrangement also shows an optional ring or sealing ring 56 positioned around the exterior diameter 52 of the rotor disk 40.

Embodiment D - shows a rotor disk 40 that includes four circular apertures 34C adjacent central opening 30 and eleven slot apertures 34S positioned in angled alignment to the axis of rotation. The rotor disk 40 also includes four deflecting blades 42 (extending out of the bottom side of rotor disk 40), which are connected to the rotor disk 40 and extend in straight outward alignment with the axis of rotation. Each of these deflecting blades 42 connect to or cross at least a portion of a slot aperture 34S. This arrangement also shows an optional ring or sealing ring 56 positioned around the exterior diameter 52 of the rotor disk 40.

Embodiment E - shows an orifice plate 28 that includes four wide curved apertures 34V positioned around the central opening 30.

Embodiment F - shows an orifice plate 28 that includes three exterior curved apertures 34V positioned in staggered alignment to three interior curved apertures 34V which are positioned around opening 30.

Embodiment G - shows an orifice plate 28 that includes eleven slot apertures 34S positioned in straight outward alignment with the axis of rotation.

Embodiment H - shows an orifice plate 28 that includes eleven slot apertures 34S positioned in angled alignment to the axis of rotation.

Embodiment I - shows an orifice plate 28 that includes four slot apertures 34S that extend in angled outward alignment with the axis of rotation, this embodiment also includes a plurality of small circular apertures 34C that are positioned between the slot apertures 34S.

Embodiment J - shows an orifice plate 28 that includes four circular apertures 34C adjacent central opening 30 and four slot apertures 34S that extend in straight outward alignment with the axis of rotation.

Embodiment K - shows a rotor disk 40 that includes four slot openings 50 positioned just behind deflecting blades 42 in the form of louvers. This arrangement also shows an optional ring or sealing ring 56 positioned around the exterior diameter 52 of the rotor disk 40.

Embodiment L - shows a rotor disk 40 that includes four circular apertures 34C adjacent central opening 30 and five slot openings 50 positioned just behind deflecting blades 42 in the form of louvers. This arrangement also shows an optional jagged exterior diameter.

In Operation: The system 10 is placed in the liquid, with the inlet end 14 positioned above the surface of the liquid and the outlet end 18 below the surface of the liquid. In this position, orifice plate 28 and rotor disk 40 are positioned below the surface of the liquid a distance. Once the motor 12 is activated, the drive shaft 20 rotates rotor disk 40, and in some arrangements orifice plate 28 as well. The rotation of the rotor disk 40 causes the liquid to flow over the deflecting blades 42 and causes air (or gas) to be drawn through the inlet ports 24 of the mounting plate 22, next through the apertures 34 of orifice plate 28 and then through the openings 50 positioned adjacent deflecting blades 42 of the rotor disk 40. Any liquid above rotor disk 40 then passes through apertures 34 into a mixture zone between orifice plate 28 and rotor disk 40 and then through openings 50 behind deflecting blades 42 of rotor disk 40 thereby forming and dispersing micro bubbles. The air is dispersed outwardly and downwardly toward the walls of the tank and then rises in the center below the aeration device 10 to create fluffing and stirring of the liquid. As a result of these design improvements, greater efficiency has been observed.

For example, using a conventional aeration device with a two horse power motor, the maximum air flow generated was a maximum of 5.8 cfm. With the new design features, using the same motor, up to 16 cfm air flow has been achieved.

When the amount of air or gas is restricted into the decompression chamber 16, the air or gas becomes less than atmospheric pressure. The air or gas is drawn into the decompression chamber 16 by the spinning of the rotor disk 40 which gives the air or gas a direction of movement through the decompression chamber 16.

Spinning of the rotor disk 40 with deflecting blades 42 causes an opening in the liquid which draws the air or gas into the liquid through the apertures 34 in the orifice plate 28 creating a vortex like action between the orifice plate 28 and the rotor disk 40.

The spinning action below the rotor disk 40 creates two motions of mixing. The liquid is drawn upward toward the center of the spinning rotor disk 40 and disperse the micro bubbles outward from the decompression chamber 16. These micro bubbles are created by the spinning rotor disk 40 between approximately 1300 rpms and 3600 rpms in a cavitation-type dynamics.

The spinning rotor disk gives the liquid a natural mixing of the micro bubbles into the liquid which over time will fill the liquid with the micro bubbles. The homogenizing of the micro bubbles move through the liquid volume via a Browning effect and slowly releases the gas into the liquid which give the effect of a time release. The air or gas is pushed outward away from the rotor disk 40 while the rotor disk 40 continues to draw the liquid to the center of the rotor disk 40 to continuously supply the combination of the gas or air and liquid to be mixed.

In this way, the "Micro Bubble Diffusion" system 10 ("MBD") is an aeration device that transfers different sizes of gas bubbles into a liquid. In this arrangement, the gaseous micro bubbles take the same identity in the liquid dynamics of the liquid being aerated. That is, due to the small size of the micro bubbles and the low volume of gas these micro bubbles hold, they create a small buoyancy force (the phenomenon which makes bubbles rise in a liquid). This buoyancy force is so small that it is less than the surrounding surface tension of the liquid. As such, the micro bubbles to not tend to rise to the surface, or at least not quickly. This allows for the micro bubbles to remain suspended in the liquid for an extended period of time which allows for increased diffusion of the micro bubble gas to transfer into the liquid which supports bacterial growth and liquid purification.

The micro bubbles formed through this process are smaller and have an increased surface to volume ratio. This allows, the micro bubbles to scrub off the gas that it holds into the liquid. The reaction of the bubbles acts as a time release process.

The micro bubbles are introduced below the surface of the liquid from a decompression process that takes the pressure from the gas bubble, as the gas bubble is allowed into the liquid the natural phenomenon of the pressure from the liquid traps the gas bubble and compresses the gas bubble to a very small micro bubble that then allows the micro bubble gas to diffuse into the liquid from a high concentration to a lower concentration.

The efficiency of the system is dependent on many variables. The amount of micro bubbles that are being introduced into the liquid needs to match the size of the motor 12 being used and the sizes of the other components as well as the thickness or viscosity of the liquid. If the components are not matched properly either the electric motor 12 will be sacrificed and/or the efficiency or amount of gas bubbles being introduced is sacrificed. Therefore, the system 10 is optimized to prevent these potential problems and maximize the efficiency of the system to transfer the maximum amount of gas without sacrificing the motor.

Figure 2:
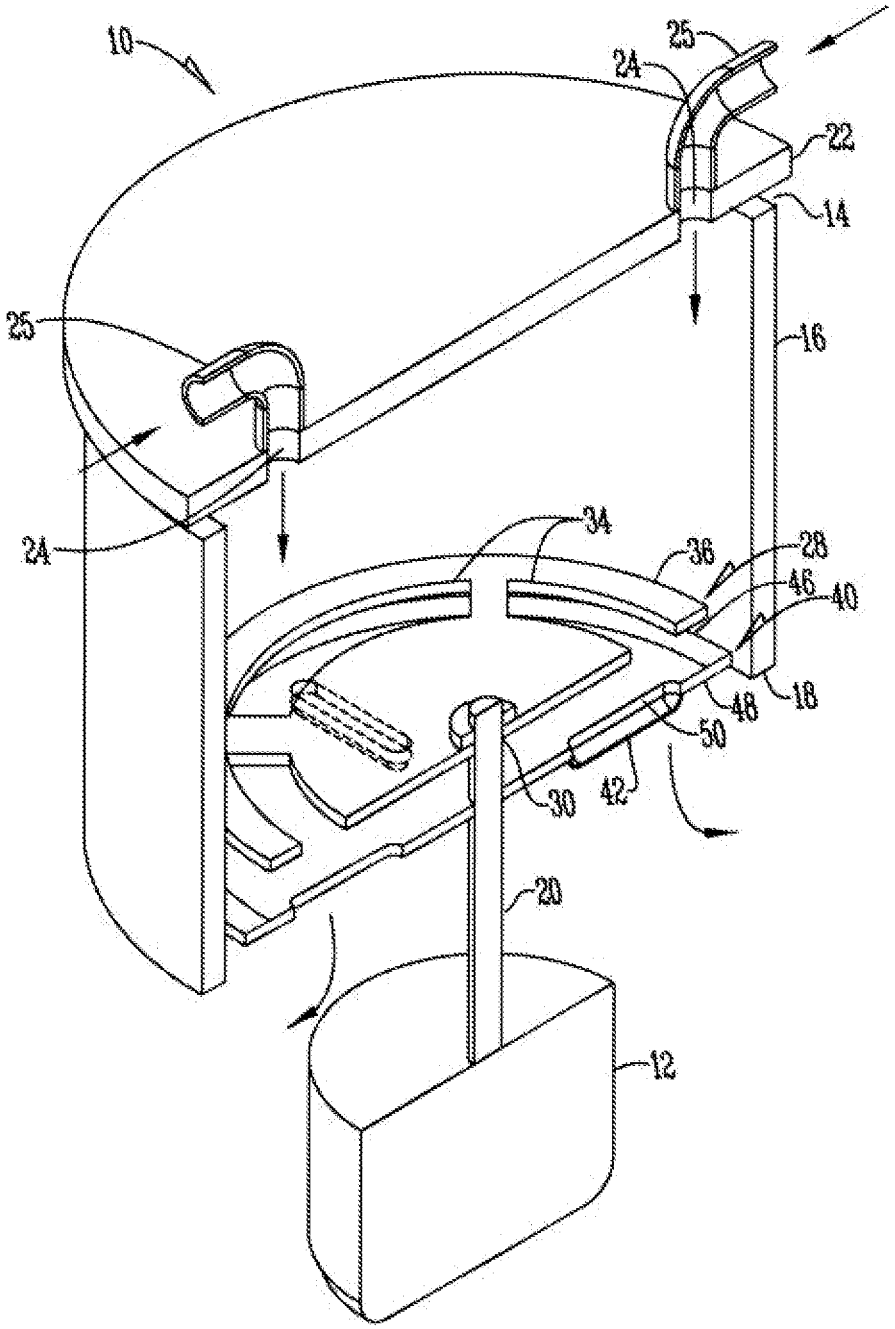
FIG. 2 is a cut-away perspective view of a micro bubble diffusion system.

Submerged Motor Arrangement: In an alternative arrangement, with reference to FIG. 2, a micro bubble diffusion system 10 is presented wherein the motor 12 is submersed in the liquid. Most if not all other components are identical to the embodiment shown in FIG. 1 with the exception of the submersible motor.

From the above discussion it will be appreciated that the method and apparatus for treatment and purification of liquid through aeration presented, at the very least, meets all the stated objectives.

That is, the method and apparatus for treatment and purification of liquid through aeration: improves upon the state of the art places less stress on a motor and increases air flow; is robust; is easy to use; produces micro bubbles that remain suspended within the liquid for an extended period of time and therefore have a greater tendency to dissolve within the liquid; reduces the odor of waste liquid and effluent; promotes bacteria growth and the aerobic breakdown of waste liquid and effluent among countless other improvements and advantages.

It will be appreciated by those skilled in the art that other various modifications could be made to the device without parting from the spirit and scope of this invention. All such modifications and changes fall within the scope of the claims and are intended to be covered thereby.

What is claimed:

1. An aeration system for the treatment and purification of liquid through aeration comprising:

a decompression chamber extending a length between an inlet end and an outlet end;

a motor connected to the decompression chamber;

a drive shaft connected to the motor and extending into a hollow interior of the decompression chamber;

wherein airflow into the hollow interior is restricted through at least one inlet port;

an orifice plate connected to the drive shaft;

wherein the orifice plate includes a plurality of apertures;

a rotor disk connected to the drive shaft and having a plurality of opening formed by bending a portion of the rotor risk out of alignment with a main body of the rotor disk which is generally flat and planar to form a plurality of deflecting blades;

wherein at least one of the plurality of deflecting blades extend out from a bottom surface of the rotor disk; and wherein when the outlet end of the system is positioned in liquid and the driveshaft and rotor disk are rotated micro bubbles are formed thereby treating and purifying the liquid.

2. The apparatus of claim 1 wherein the motor is submerged in the liquid.

3. The apparatus of claim 1 wherein the motor is positioned above the decompression chamber.

4. The apparatus of claim 1 wherein the at least one inlet port is manually or automatically adjustable.

5. The apparatus of claim 1 wherein the plurality of deflecting blades are angled from a top surface of the rotor disk to the bottom surface of the rotor disk.

6. The apparatus of claim 1 wherein rotation of the rotor disk creates a vortex in the liquid.

7. The apparatus of claim 1 wherein rotation of the rotor disk creates a vortex in the liquid pushing micro bubbles outward from the rotor disk.

8. The apparatus of claim 1 wherein rotating the rotor disk with deflecting blades creates openings in the liquid which draws the air or gas into the liquid through the apertures in the orifice plate.

9. The apparatus of claim 1 wherein the orifice plate is connected to the driveshaft and rotates with the driveshaft.

10. The apparatus of claim 1 wherein an opening is positioned in the rotor disk adjacent at least one of the deflecting blades, wherein the opening is positioned rearward of the deflecting blade in the direction of rotation.

11. The apparatus of claim 1 wherein the deflecting blades have an angle of deflection between 10 and 70 degrees in relation to the rotor disk.

12. The apparatus of claim 1 wherein the deflecting blades have an angle of deflection between 20 and 60 degrees in relation to the rotor disk.

* * * * *